US011001347B1

(12) United States Patent
Peterson

(10) Patent No.: US 11,001,347 B1
(45) Date of Patent: May 11, 2021

(54) INFLATABLE TOWABLE VEHICLE SPINNER APPARATUS AND SYSTEM

(71) Applicant: SDS Asia Limited, BVI #1748971, Hong Kong (CN)

(72) Inventor: Leroy L. Peterson, Omaha, NE (US)

(73) Assignee: SDS ASIA LIMITED, BVI # 1748971, Central Hong Kong (CN)

( * ) Notice: Subject to any disclaimer, the term of this patent is extended or adjusted under 35 U.S.C. 154(b) by 32 days.

(21) Appl. No.: 16/678,732

(22) Filed: Nov. 8, 2019

Related U.S. Application Data

(63) Continuation-in-part of application No. 29/702,416, filed on Aug. 19, 2019, and a continuation-in-part of application No. 29/702,422, filed on Aug. 19, 2019.

(51) Int. Cl.

| | |
|---|---|
| ***B63B 32/20*** | (2020.01) |
| ***B63B 34/50*** | (2020.01) |
| *B63B 32/30* | (2020.01) |
| *B63B 32/60* | (2020.01) |

(52) U.S. Cl.
CPC ..... *B63B 32/20* (2020.02); *B63B 34/50* (2020.02); *B63B 32/30* (2020.02); *B63B 32/60* (2020.02)

(58) Field of Classification Search
CPC ..... B63B 32/20; B63B 32/30; B63B 32/60; B63B 34/50
See application file for complete search history.

(56) References Cited

U.S. PATENT DOCUMENTS 4,619,620 A * 10/1986 Felter ..... B63B 32/20 441/66
4,807,554 A * 2/1989 Chi-Hung ..... B63B 7/08 114/253
5,383,804 A * 1/1995 Mitch ..... B63B 34/50 441/66
5,702,278 A * 12/1997 Boucher ..... B63B 34/63 709/243
7,594,837 B1 9/2009 Peterson
2012/0060652 A1* 3/2012 Gapp ..... B25B 13/08 81/58.2

FOREIGN PATENT DOCUMENTS

KR 101802944 B1 11/2017

OTHER PUBLICATIONS

European Extended Search Report for Application No. 20153670.3 dated Jul. 23, 2020, 7 pages.

* cited by examiner

*Primary Examiner* — Stephen P Avila
(74) *Attorney, Agent, or Firm* — Suiter Swantz pc llo

(57) ABSTRACT

A system may include an inflatable towable vehicle. The inflatable towable vehicle may include a spinner apparatus attached to a bottom side of the inflatable towable vehicle. At least a portion of the spinner apparatus may be configured to be submerged when the inflatable towable vehicle is towed in water. The spinner apparatus may include: a base configured to abut the bottom side of the inflatable towable vehicle when the spinner apparatus is attached to the bottom side of the inflatable towable vehicle; a post extending away from the base; a cylindrical tube, wherein the post may extend through the cylindrical tube, wherein the cylindrical tube may be configured to rotate around the post; and a tow rope attachment member attached to and extending from the cylindrical tube. The inflatable towable vehicle may be configured to rotate as the inflatable towable vehicle is towed.

20 Claims, 14 Drawing Sheets

INFLATABLE TOWABLE VEHICLE SPINNER APPARATUS AND SYSTEM

CROSS-REFERENCE TO RELATED APPLICATIONS

This application is a continuation-in-part of and claims priority to: (a) U.S. patent application Ser. No. 29/702,416, filed on Aug. 19, 2019, and (b) U.S. patent application Ser. No. 29/702,422, filed on Aug. 19, 2019, which are herein incorporated by reference in their entirety.

BACKGROUND

Riding inflatable towable vehicles, which may be towed by a watercraft, is a common recreational activity. Current inflatable towable vehicles do not rotate when towed by a watercraft. Previous attempts to cause rotation of inflatable towable vehicles when towed has resulted in rotation that spins too quickly, causing sickness and dizziness for the riders.

SUMMARY

In one aspect, embodiments of the inventive concepts disclosed herein are directed to a system. The system may include an inflatable towable vehicle. The inflatable towable vehicle may include a spinner apparatus attached to a bottom side of the inflatable towable vehicle. At least a portion of the spinner apparatus may be configured to be submerged when the inflatable towable vehicle is towed in water. The spinner apparatus may include: a base configured to abut the bottom side of the inflatable towable vehicle when the spinner apparatus is attached to the bottom side of the inflatable towable vehicle; a post extending away from the base; a cylindrical tube, wherein the post may extend through the cylindrical tube, wherein the cylindrical tube may be configured to rotate around the post; and a tow rope attachment member attached to and extending from the cylindrical tube. The inflatable towable vehicle may be configured to rotate as the inflatable towable vehicle is towed.

In a further aspect, embodiments of the inventive concepts disclosed herein are directed to an inflatable towable vehicle. The inflatable towable vehicle may include a spinner apparatus attached to a bottom side of the inflatable towable vehicle. At least a portion of the spinner apparatus may be configured to be submerged when the inflatable towable vehicle is towed in water. The spinner apparatus may include: a base configured to abut the bottom side of the inflatable towable vehicle when the spinner apparatus is attached to the bottom side of the inflatable towable vehicle; a post extending away from the base; a cylindrical tube, wherein the post may extend through the cylindrical tube, wherein the cylindrical tube may be configured to rotate around the post; and a tow rope attachment member attached to and extending from the cylindrical tube. The inflatable towable vehicle may be configured to rotate as the inflatable towable vehicle is towed.

In a further aspect, embodiments of the inventive concepts disclosed herein are directed to a spinner apparatus. The spinner apparatus may include: a base configured to abut a bottom side of an inflatable towable vehicle when the spinner apparatus is attached to the bottom side of the inflatable towable vehicle; a post extending from the base; a cylindrical tube, wherein the post may extend through the cylindrical tube, wherein the cylindrical tube may be configured to rotate around the post; and a tow rope attachment member attached to and extending from the cylindrical tube.

BRIEF DESCRIPTION OF THE DRAWINGS

Implementations of the inventive concepts disclosed herein may be better understood when consideration is given to the following detailed description thereof. Such description makes reference to the included drawings, which are not necessarily to scale, and in which some features may be exaggerated and some features may be omitted or may be represented schematically in the interest of clarity. Like reference numerals in the drawings may represent and refer to the same or similar element, feature, or function. In the drawings.

DETAILED DESCRIPTION

Figure 1:
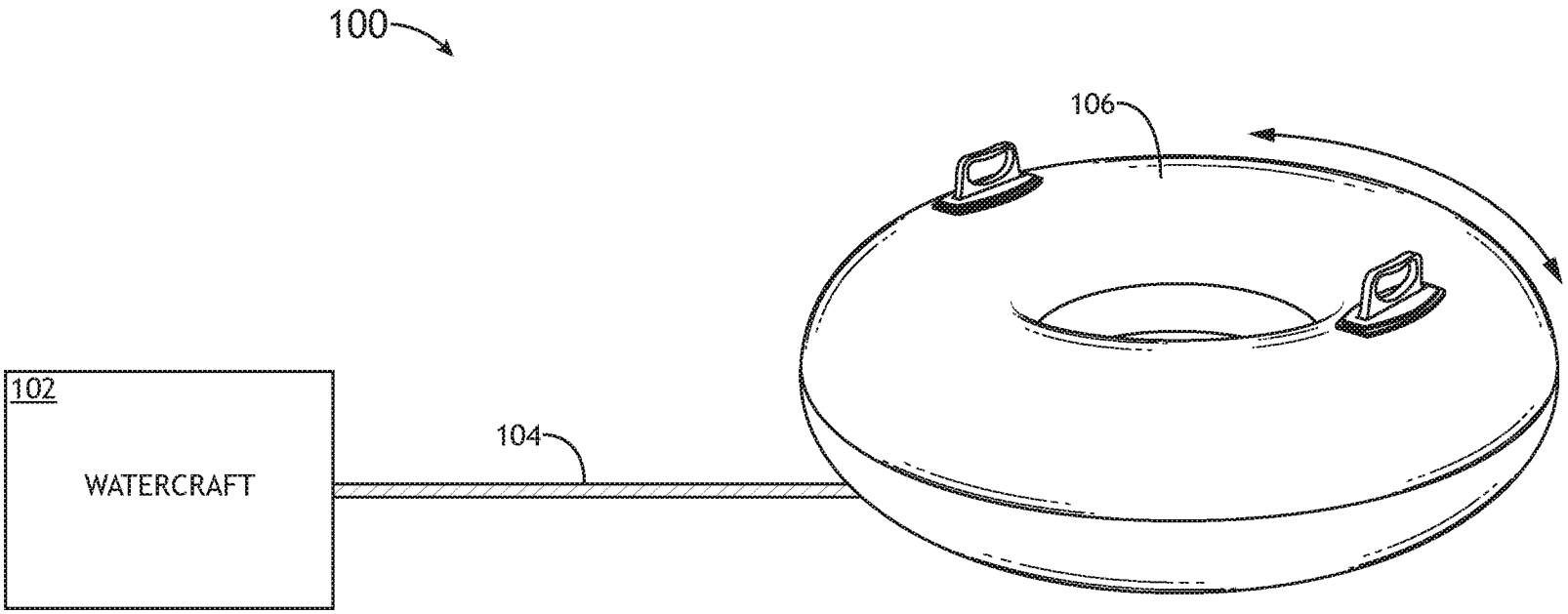
FIG. 1 is a perspective view of an exemplary embodiment of a system including a watercraft, a tow rope, and an inflatable towable vehicle according to the inventive concepts disclosed herein.

Before explaining at least one embodiment of the inventive concepts disclosed herein in detail, it is to be understood that the inventive concepts are not limited in their application to the details of construction and the arrangement of the components or steps or methodologies set forth in the following description or illustrated in the drawings. In the following detailed description of embodiments of the instant inventive concepts, numerous specific details are set forth in order to provide a more thorough understanding of the inventive concepts. However, it will be apparent to one of ordinary skill in the art having the benefit of the instant disclosure that the inventive concepts disclosed herein may be practiced without these specific details. In other instances, well-known features may not be described in detail to avoid unnecessarily complicating the instant disclosure. The inventive concepts disclosed herein are capable of other embodiments or of being practiced or carried out in various ways. Also, it is to be understood that the phraseology and terminology employed herein is for the purpose of description and should not be regarded as limiting.

As used herein a letter following a reference numeral is intended to reference an embodiment of the feature or element that may be similar, but not necessarily identical, to a previously described element or feature bearing the same reference numeral (e.g., 1, 1*a*, 1*b*). Such shorthand notations are used for purposes of convenience only, and should not be construed to limit the inventive concepts disclosed herein in any way unless expressly stated to the contrary.

Further, unless expressly stated to the contrary, "or" refers to an inclusive or and not to an exclusive or. For example, a condition A or B is satisfied by anyone of the following: A is true (or present) and B is false (or not present), A is false (or not present) and B is true (or present), and both A and B are true (or present).

In addition, use of the "a" or "an" are employed to describe elements and components of embodiments of the instant inventive concepts. This is done merely for convenience and to give a general sense of the inventive concepts, and "a" and "an" are intended to include one or at least one and the singular also includes the plural unless it is obvious that it is meant otherwise.

Finally, as used herein any reference to "one embodiment," or "some embodiments" means that a particular element, feature, structure, or characteristic described in connection with the embodiment is included in at least one embodiment of the inventive concepts disclosed herein. The appearances of the phrase "in some embodiments" in various places in the specification are not necessarily all referring to the same embodiment, and embodiments of the inventive concepts disclosed may include one or more of the features expressly described or inherently present herein, or any combination of sub-combination of two or more such features, along with any other features which may not necessarily be expressly described or inherently present in the instant disclosure.

Broadly, embodiments of the inventive concepts disclosed herein are directed to a spinner apparatus, an inflatable towable vehicle including the spinner apparatus, and a system, wherein the spinner apparatus allows the inflatable towable vehicle to rotate as the inflatable towable vehicle is towed. In some embodiments, the spinner apparatus allows the inflatable towable vehicle to spin at a tolerable rate for riders.

Referring now to FIG. 1, a perspective view of an exemplary embodiment of a system 100 including a watercraft 102, a tow rope 104, and an inflatable towable vehicle 106 according to the inventive concepts disclosed herein is depicted. The tow rope 104 may be connected to the watercraft 102 and the inflatable towable vehicle 106. For example, the watercraft 102 may be a motor boat or a jet ski. The inflatable towable vehicle 106 may include a spinner apparatus 108, as shown in and described with respect to FIGS. 2-14. The watercraft 102 may tow the inflatable towable vehicle 106 on water. The inflatable towable vehicle 106 may rotate as the inflatable towable vehicle 106 is towed. In some embodiments, the inflatable towable vehicle 106 may rotate more quickly as the watercraft 102 turns than as the watercraft 102 drives straight. In some embodiments, the watercraft 102 may include handles, and a rider of the inflatable towable vehicle 106 may be able to control a rate and/or direction of rotation by shifting the rider's weight from one side of the inflatable towable vehicle 106 toward another side (e.g., from one handle to another handle).

Figure 2:
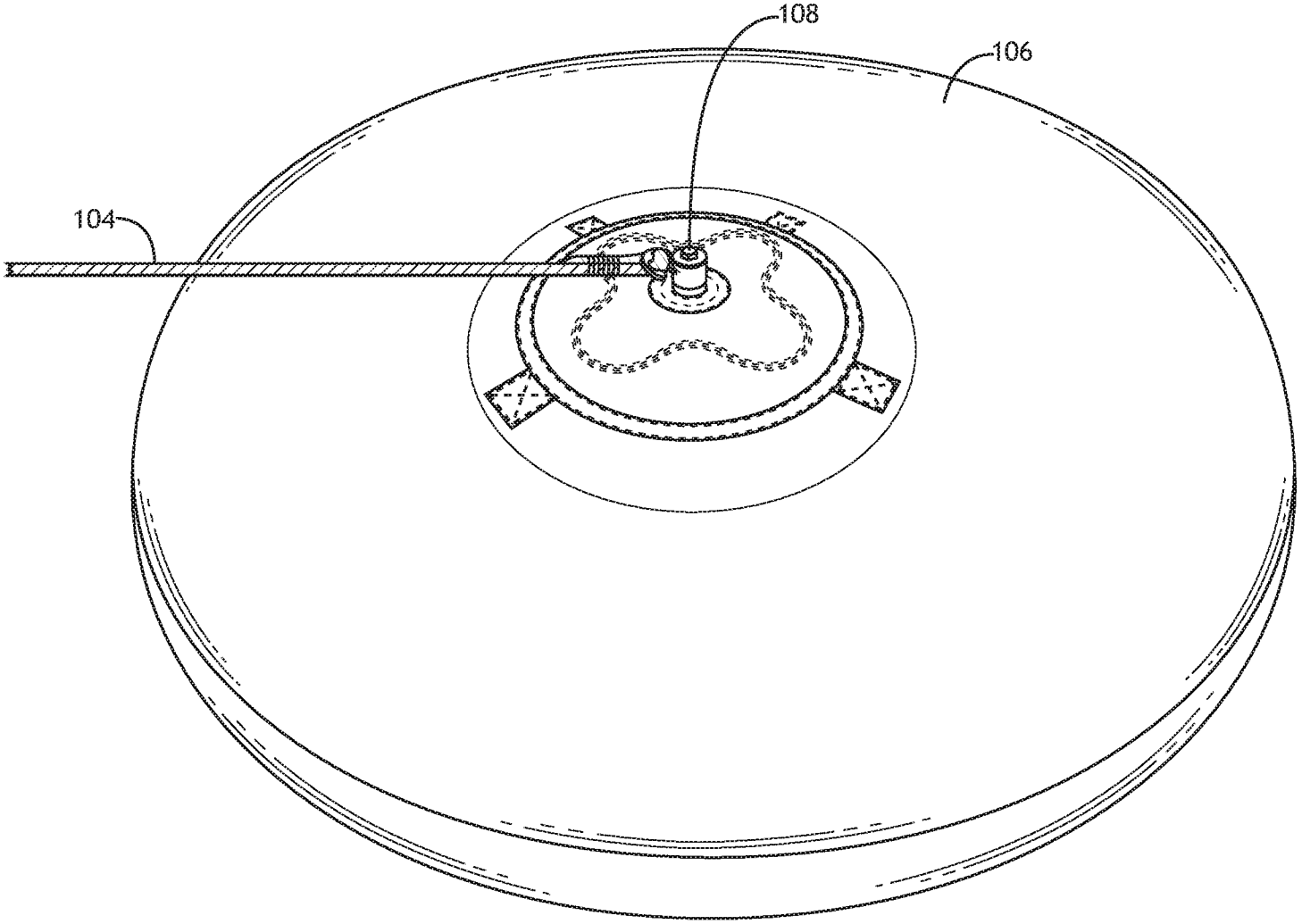
FIG. 2 is a bottom perspective view of an exemplary embodiment of the tow rope connected to a spinner apparatus of the inflatable towable vehicle of FIG. 1 according to the inventive concepts disclosed herein.
Figure 3:
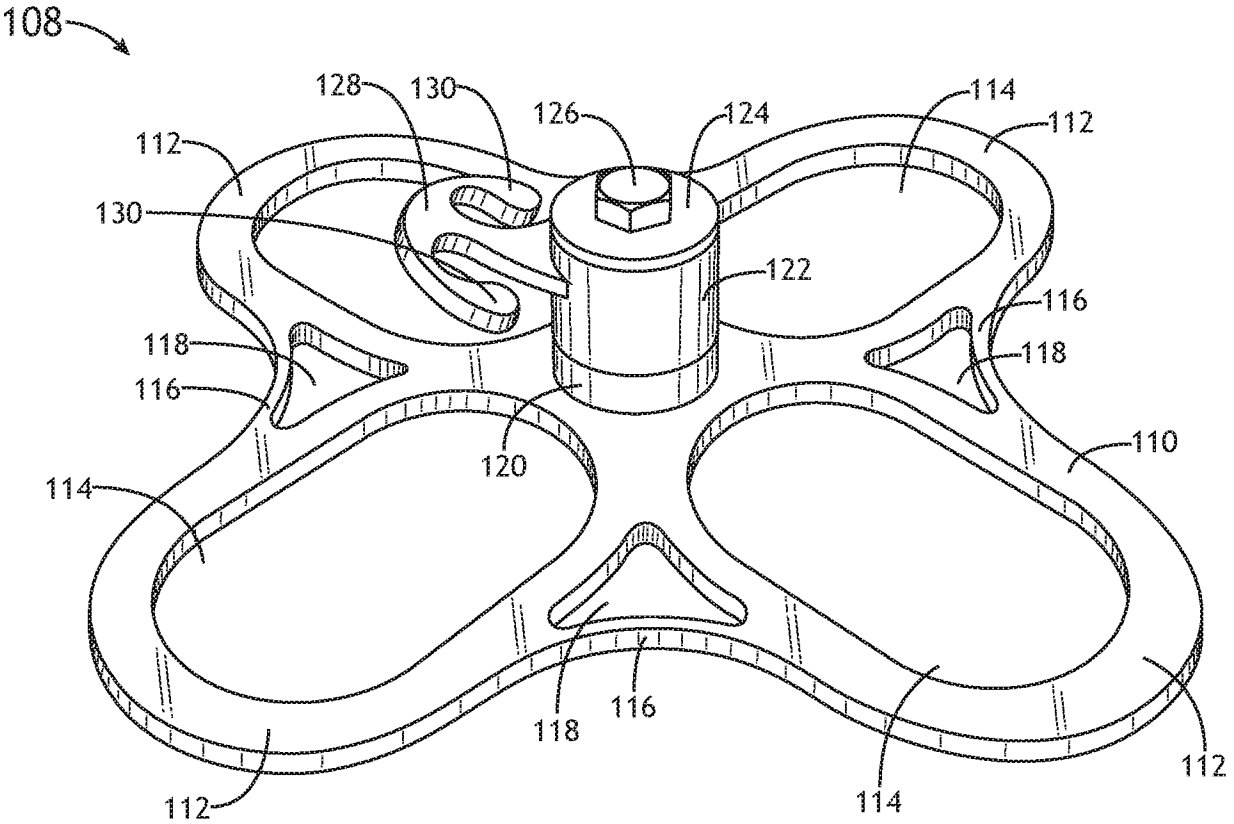
FIG. 3 is a bottom perspective view of an exemplary embodiment of the spinner apparatus of FIGS. 1-2 according to the inventive concepts disclosed herein.
Figure 4:
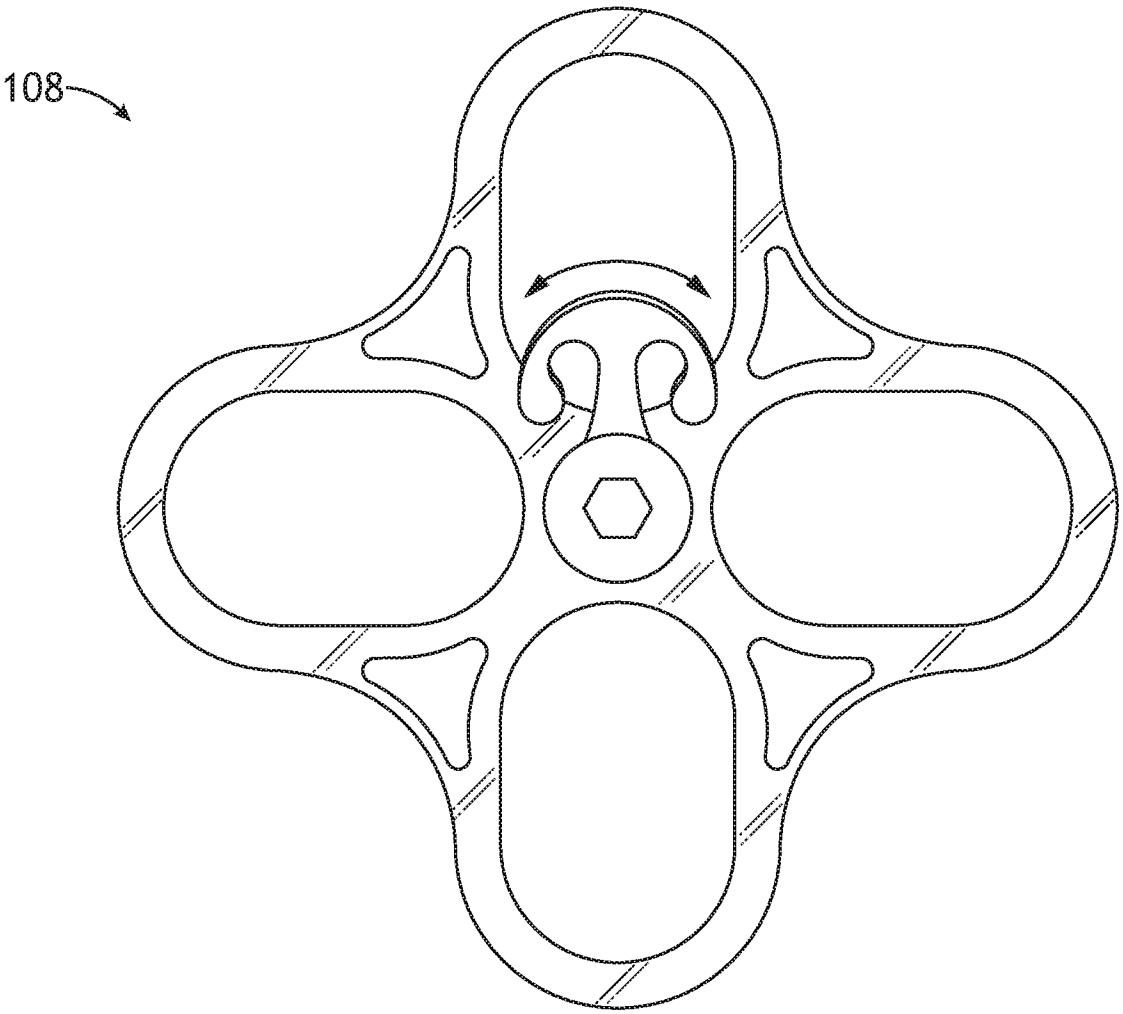
FIG. 4 is a bottom plan view of an exemplary embodiment of the spinner apparatus of FIGS. 1-2 according to the inventive concepts disclosed herein.
Figure 5:
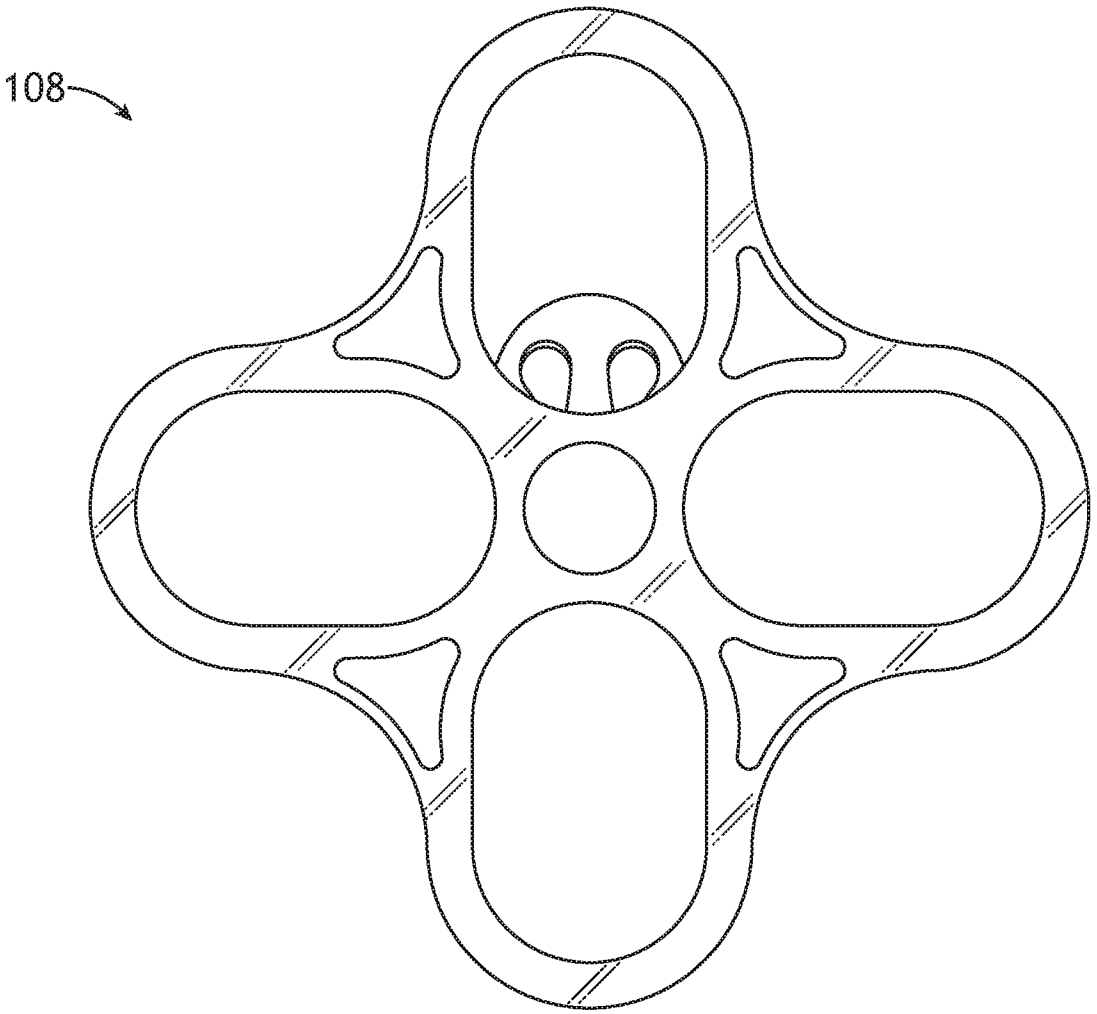
FIG. 5 is a top plan view of an exemplary embodiment of the spinner apparatus of FIGS. 1-2 according to the inventive concepts disclosed herein.
Figure 6:
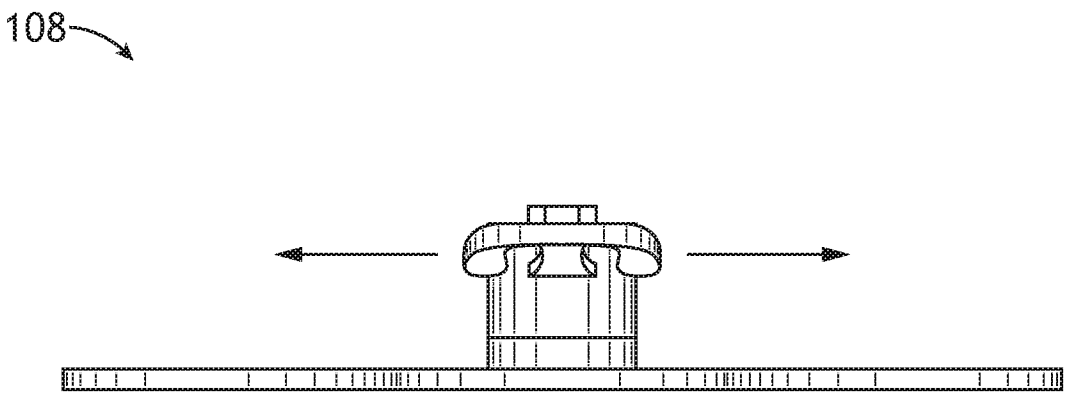
FIG. 6 is a rear side elevation upside-down view of an exemplary embodiment of the spinner apparatus of FIGS. 1-2 according to the inventive concepts disclosed herein.
Figure 7:
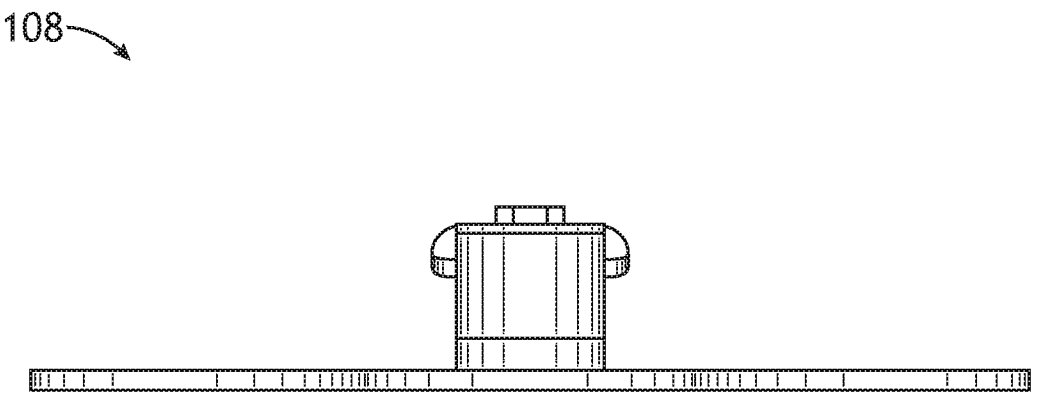
FIG. 7 is a front side elevation upside-down view of an exemplary embodiment of the spinner apparatus of FIGS. 1-2 according to the inventive concepts disclosed herein.
Figure 8:
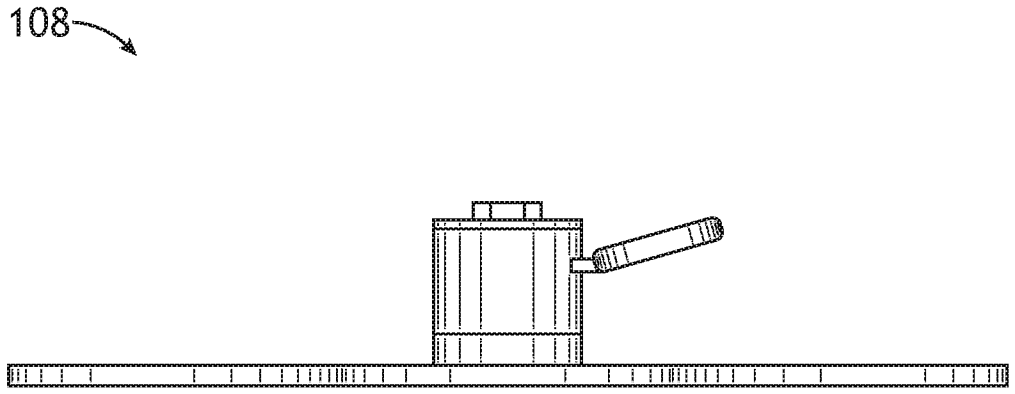
FIG. 8 is a left-side elevation upside-down view of an exemplary embodiment of the spinner apparatus of FIGS. 1-2 according to the inventive concepts disclosed herein.
Figure 9:
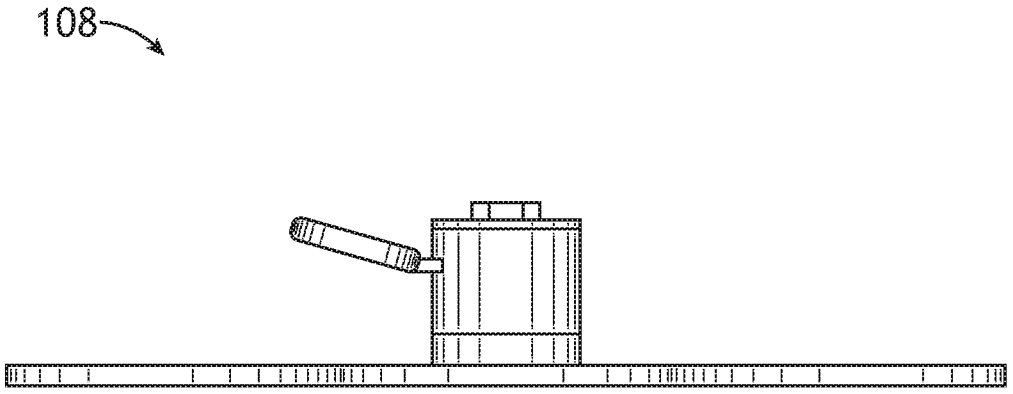
FIG. 9 is a right-side elevation upside-down view of an exemplary embodiment of the spinner apparatus of FIGS. 1-2 according to the inventive concepts disclosed herein.
Figure 10:
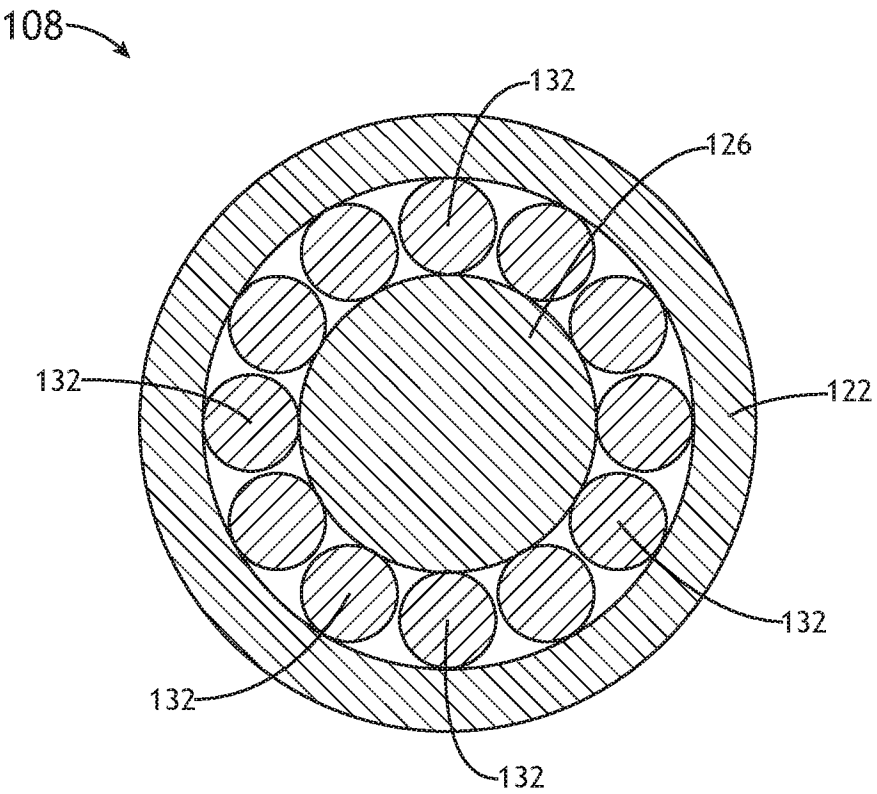
FIG. 10 is a cross-section view of a portion of an exemplary embodiment of the spinner apparatus of FIGS. 1-2 according to the inventive concepts disclosed herein.
Figure 11:
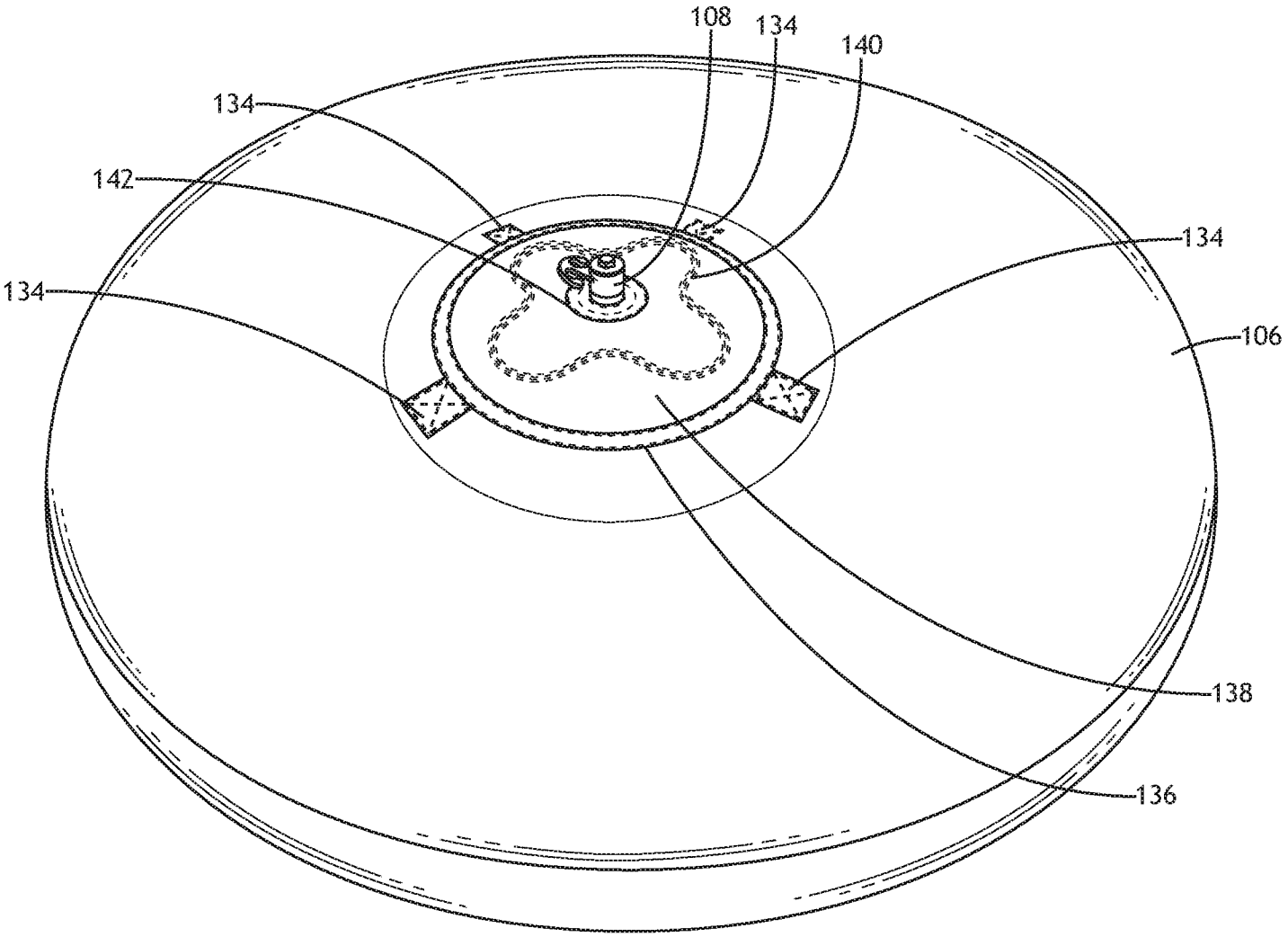
FIG. 11 is a bottom perspective view of an exemplary embodiment of the inflatable towable vehicle including the spinner apparatus of FIGS. 1-2 according to the inventive concepts disclosed herein.
Figure 12:
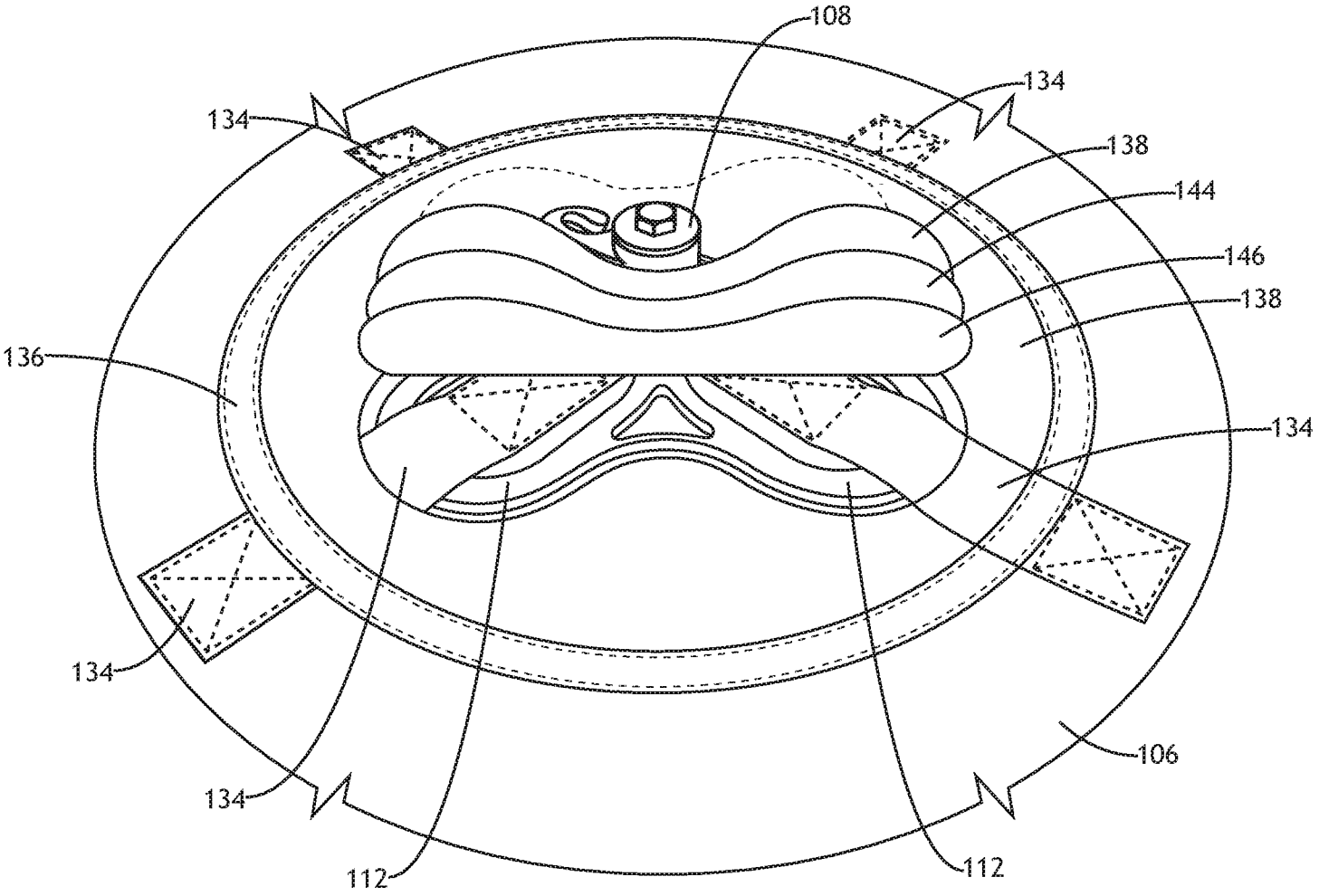
FIG. 12 is a bottom perspective partial cut-away view of an exemplary embodiment of the inflatable towable vehicle including the spinner apparatus of FIGS. 1-2 according to the inventive concepts disclosed herein.
Figure 13:
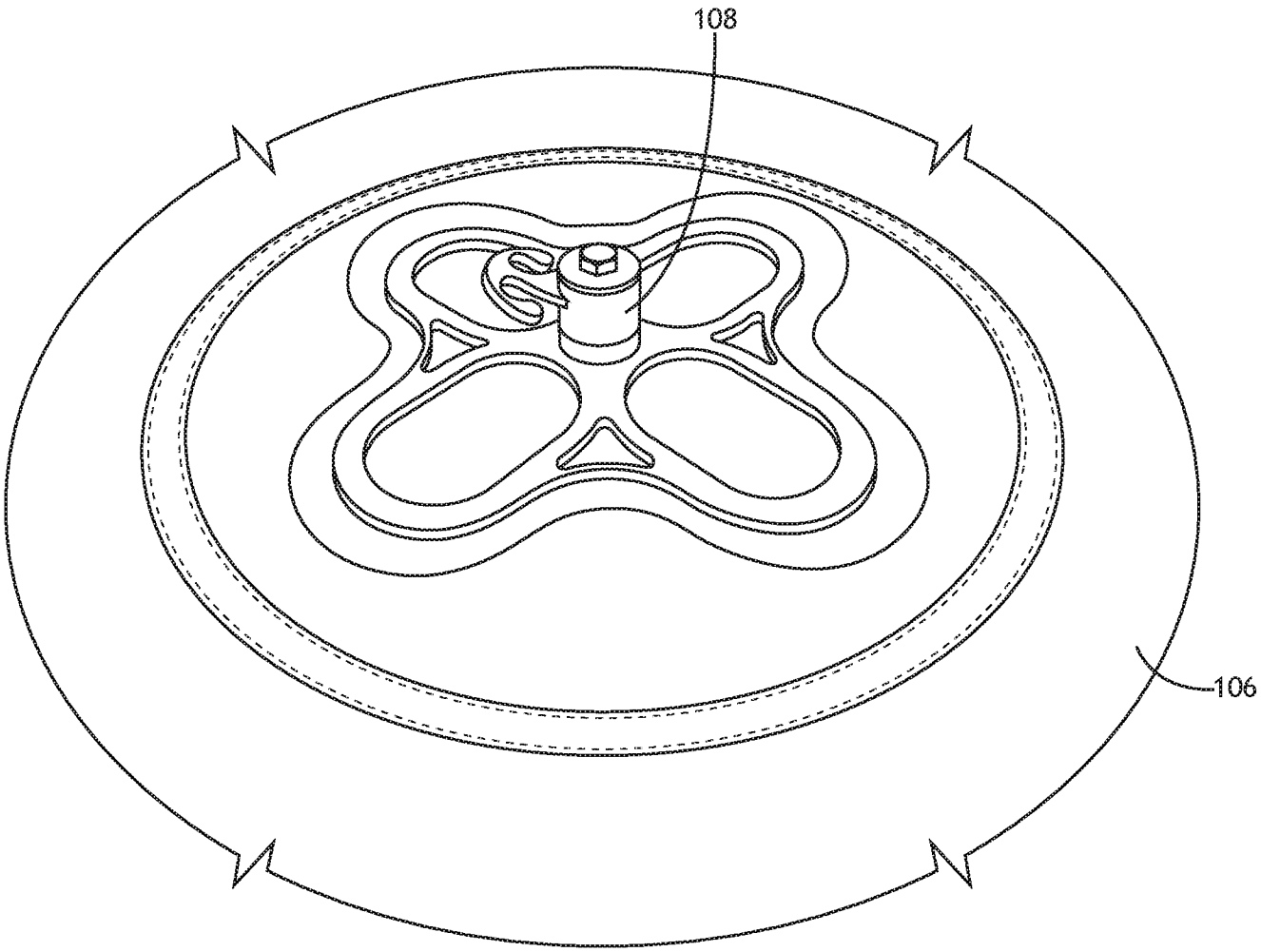
FIG. 13 is a bottom perspective partial cut-away view of an exemplary embodiment of the inflatable towable vehicle including the spinner apparatus of FIGS. 1-2 according to the inventive concepts disclosed herein.
Figure 14:
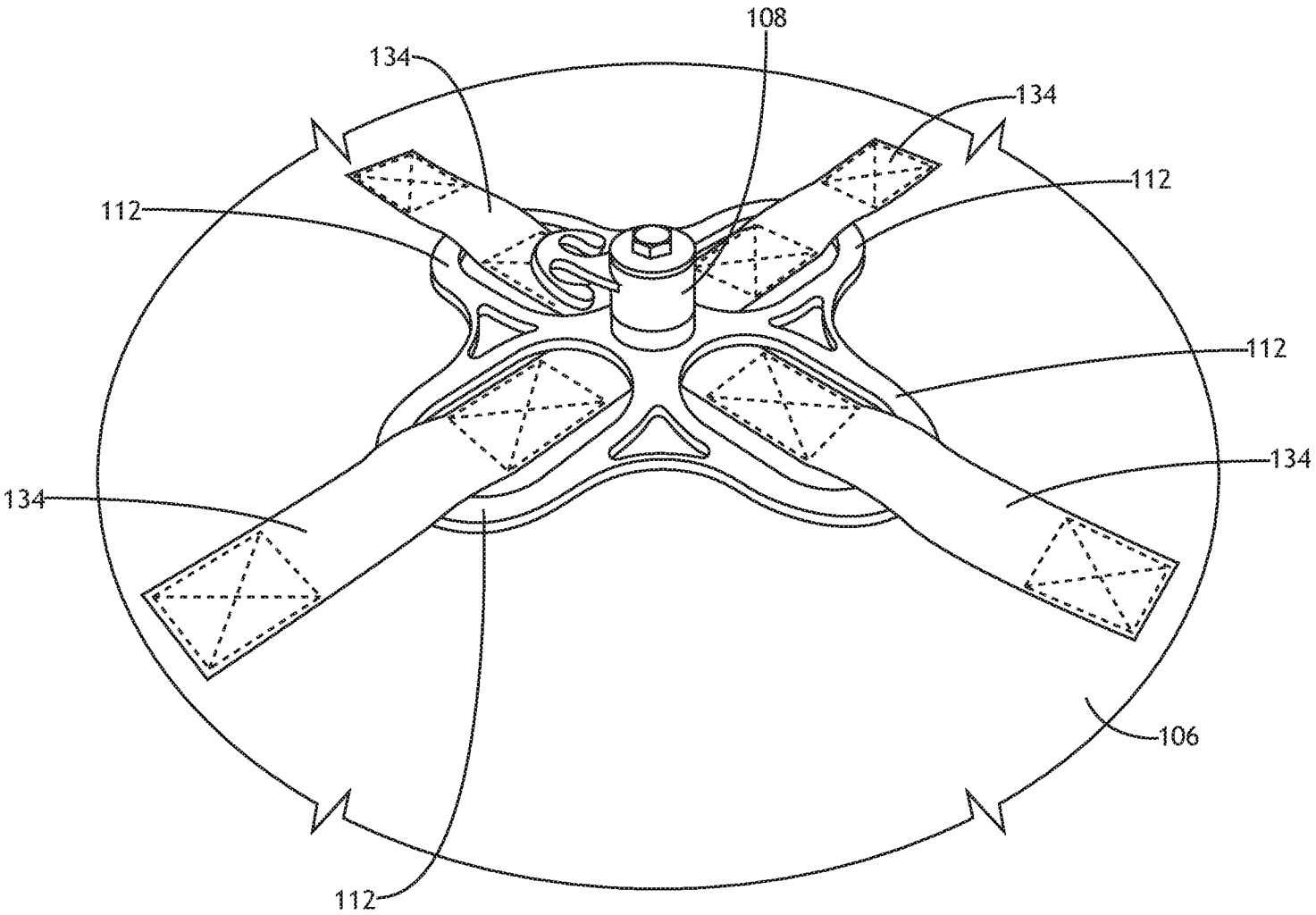
FIG. 14 is a bottom perspective partial cut-away view of an exemplary embodiment of the inflatable towable vehicle including the spinner apparatus of FIGS. 1-2 according to the inventive concepts disclosed herein.

Referring now to FIG. 2, a bottom view of an exemplary embodiment of the tow rope 104 connected to a spinner apparatus 108 of the inflatable towable vehicle 106 of FIG. 1 according to the inventive concepts disclosed herein is depicted. The inflatable towable vehicle 106 may include the spinner apparatus 108 attached to a bottom side of the inflatable towable vehicle 106. At least a portion of the spinner apparatus 108 may be configured to be submerged when the inflatable towable vehicle 106 is towed in water.

Referring now to FIG. 3-10, various views of an exemplary embodiment of the spinner apparatus 108 of FIGS. 1-2 according to the inventive concepts disclosed herein are depicted. The spinner apparatus 108 may include a base 110, at least two (e.g., four) strap rings 112, at least two (e.g., four) strap holes, at least two (e.g., four) strap ring support members 116, at least two (e.g., four) holes 118, a post base portion 120, a cylindrical tube 122, at least one washer 124, a post 126, a tow rope attachment member 128, and/or ball bear bearings 132. The spinner apparatus 108 may be attached to a center of the bottom side of the inflatable towable vehicle 106. The spinner apparatus 108 may be composed in part or whole of at least one metal (e.g., steel, brass, and/or aluminum).

The base 110 may be configured to abut the bottom side of the inflatable towable vehicle 106 when the spinner apparatus 108 is attached to the bottom side of the inflatable towable vehicle 106. In some embodiments, the base 110 may have flat and parallel top and bottom surfaces. The base 110 may include the strap rings 112 and the ring support members 116.

Each of the strap rings 112 may form a strap hole 114. In some embodiments, the strap rings 112 may be equally radially spaced apart and may be uniformly shaped and sized. For example, the strap holes 114 may have any suitable shape, such as rectangular shaped or oblong shaped (e.g., circular oblong shaped).

For example, each of the ring support members 116 may be coupled between two adjacent strap rings 112 such that a hole 118 (e.g., a generally triangular hole) is formed.

The spinner apparatus 108 may include the post base portion 120, which may be attached to a center of the base 110. The post base portion 120 may be cylindrical and may extend away from the base 110.

The post 126 may extend away from the base 110 and/or the post base portion 120. For example, the post 126 may be attached to the post base portion 120. In some embodiments, the post may be a bolt. The post 126 may include a cylindrical shaft and head (e.g., a bolt head). The post 126 may extend through the cylindrical tube 122. The post 126 may be positioned at a center of the bottom side of the inflatable towable vehicle 106.

The cylindrical tube 122 may be configured to rotate around the post 126 such that the inflatable towable vehicle 106 may rotate as the inflatable towable vehicle 106 is towed. An end of the cylindrical tube 122 may abut the post base portion 120. The spinner apparatus 108 may include the ball bear bearings 132 positioned between the cylindrical tube 122 and the post 126. The washer 124 may be positioned between the head of the post 126 and an end of the cylindrical tube 122. In some embodiments, the washer 124 may be rigidly attached (e.g., welded) to the head of the post 126 and/or stationary with respect to the post 126. The washer 124 may keep the ball bearings 132 positioned between the cylindrical tube 122 and the post 126.

The tow rope attachment member 128 may be attached (e.g., welded) to and may extend from the cylindrical tube 122. The tow rope 104 may be connected (e.g., tied to and/or looped around) to the tow rope attachment member 128. The tow rope attachment member 128 may include a neck portion and at least one (e.g., two) hook portion. The neck portion may be positioned between the at least one hook portion and the cylindrical tube 122. In some embodiments, the tow rope attachment member 128 may extends away from the base 110 as the tow rope attachment member 128 extend away from the cylindrical tube 122.

Referring now to FIGS. 11-14, various bottom views of an exemplary embodiment of the inflatable towable vehicle 106 including the spinner apparatus 108 of FIGS. 1-2 according to the inventive concepts disclosed herein are depicted.

The inflatable towable vehicle 106 may include at least one (e.g., two or four) strap 134. Each strap 134 may be threaded through one or more (e.g., one or two) of the strap rings 112 such that outer portions of each strap ring 112 are positioned and secured between a bottom side of the inflatable towable vehicle 106 and a strap 134. Ends of each strap 134 may be attached (e.g., stitched) to the bottom side of the inflatable towable vehicle 106. Additionally, a portion of each strap 134 that is threaded through a strap ring 112 may be attached (e.g., stitched) to the bottom side of the inflatable towable vehicle 106 to secure the spinner apparatus 108 against the bottom side of the inflatable towable vehicle 106.

The inflatable towable vehicle 106 may include at least one (e.g., three) fabric cover layer 138, 144, and/or 146. The base 110 of the spinner apparatus may be positioned between the at least one fabric cover layer 138, 144, and/or 146 and the bottom side of the inflatable towable vehicle 106. For example, each of the at least one (e.g., three) fabric cover layer 138, 144, and/or 146 may be composed of any suitable material, such as nylon or tarpaulin. For example, a first fabric cover layer 138 may be composed of nylon and may be an outer layer, a second first fabric cover layer 144 may be composed of a nylon and may be a middle layer, and a third fabric cover layer 146 may be composed of tarpaulin and may be an inner layer closest to the bottom side of the inflatable towable vehicle 106. The at least one (e.g., three) fabric cover layer 138, 144, and/or 146 may include a center hole to allow a portion of the spinner apparatus 108 to extend through the hole. The at least one (e.g., three) fabric cover layer 138, 144, and/or 146 may be attached to the to the bottom side of the inflatable towable vehicle 106 at various locations. For example, the at least one (e.g., three) fabric cover layer 138, 144, and/or 146 may be attached (e.g., stitched) to the bottom side of the inflatable towable vehicle 106 along outer circumferential edges of the at least one fabric cover layer 138, 144, and/or 146. For example, the at least one (e.g., three) fabric cover layer 138, 144, and/or 146 may be attached (e.g., stitched with stitching 140) to the bottom side of the inflatable towable vehicle 106 around outer portions of the base 110 of the spinner apparatus 108.

The inflatable towable vehicle 106 may include a first reinforcement ring 142 around a portion of the spinner apparatus 108 that extends through the at least one (e.g., three) fabric cover layer 138, 144, and/or 146 from the bottom side of the inflatable towable vehicle 106. The at least one fabric cover layer 138, 144, and/or 146 may be positioned between the reinforcement ring 142 and the base 110 of the spinner apparatus 108, and the first reinforcement ring 142 may be attached (e.g., stitched) to the at least one fabric cover layer 138, 144, and/or 146. The first reinforcement ring 142 may be composed of any suitable material, such as tarpaulin or nylon.

The inflatable towable vehicle 106 may include a second reinforcement ring 136 over outer circumferential edges of the at least one fabric cover layer 138, 144, and/or 146. The at least one fabric cover layer 138, 144, and/or 146 may be positioned between the second reinforcement ring 136 and the bottom side of the inflatable towable vehicle 106.

As will be appreciated from the above, embodiments of the inventive concepts disclosed herein may be directed to a spinner apparatus, an inflatable towable vehicle including the spinner apparatus, and a system, wherein the spinner apparatus allows the inflatable towable vehicle to rotate as the inflatable towable vehicle is towed.

As used throughout, "at least one" means one or a plurality of; for example, "at least one" may comprise one, two, three, . . . , one hundred, or more. Similarly, as used throughout, "one or more" means one or a plurality of; for example, "one or more" may comprise one, two, three, . . . , one hundred, or more. Further, as used throughout, "zero or more" means zero, one, or a plurality of; for example, "zero or more" may comprise zero, one, two, three, . . . , one hundred, or more.

In the present disclosure, the methods, operations, and/or functionality disclosed may be implemented as sets of instructions or software readable by a device. Further, it is understood that the specific order or hierarchy of steps in the methods, operations, and/or functionality disclosed are examples of exemplary approaches. Based upon design preferences, it is understood that the specific order or hierarchy of steps in the methods, operations, and/or functionality can be rearranged while remaining within the scope of the inventive concepts disclosed herein. The accompanying claims may present elements of the various steps in a sample order, and are not necessarily meant to be limited to the specific order or hierarchy presented.

It is to be understood that embodiments of the methods according to the inventive concepts disclosed herein may include one or more of the steps described herein. Further, such steps may be carried out in any desired order and two or more of the steps may be carried out simultaneously with one another. Two or more of the steps disclosed herein may be combined in a single step, and in some embodiments, one or more of the steps may be carried out as two or more sub-steps. Further, other steps or sub-steps may be carried in addition to, or as substitutes to one or more of the steps disclosed herein.

From the above description, it is clear that the inventive concepts disclosed herein are well adapted to carry out the objects and to attain the advantages mentioned herein as well as those inherent in the inventive concepts disclosed herein. While presently preferred embodiments of the inventive concepts disclosed herein have been described for purposes of this disclosure, it will be understood that numerous changes may be made which will readily suggest themselves to those skilled in the art and which are accomplished within the broad scope and coverage of the inventive concepts disclosed and claimed herein.

What is claimed is:

1. A system, comprising:

an inflatable towable vehicle, comprising:

a spinner apparatus attached to a bottom side of the inflatable towable vehicle, at least a portion of the spinner apparatus configured to be submerged when the inflatable towable vehicle is towed in water, the spinner apparatus comprising:

a base configured to abut the bottom side of the inflatable towable vehicle when the spinner apparatus is attached to the bottom side of the inflatable towable vehicle;

a post extending away from the base;

a cylindrical tube, wherein the post extends through the cylindrical tube, wherein the cylindrical tube is configured to rotate around the post; and a tow rope attachment member attached to and extending from the cylindrical tube, wherein the inflatable towable vehicle is configured to rotate as the inflatable towable vehicle is towed, wherein the base comprises at least two strap rings, each of the at least two strap rings forming a strap hole, wherein the at least two strap rings comprises four strap rings equally radially spaced apart.

2. The system of claim 1, wherein the post is positioned at a center of the bottom side.

3. The system of claim 1, wherein the spinner apparatus further comprises ball bear bearings positioned between the cylindrical tube and the post.

4. The system of claim 1, wherein the inflatable towable vehicle further comprises at least one strap, each of the at least one strap threaded through one or more of the at least two strap rings, wherein ends of each of the at least one strap are attached to the bottom side of the inflatable towable vehicle.

5. The system of claim 1, wherein the base further comprises at least one ring support member coupled between two of the at least two strap rings.

6. The system of claim 1, wherein the tow rope attachment member comprises a neck portion and at least one hook portion, the neck portion positioned between the at least one hook portion and the cylindrical tube.

7. The system of claim 6, wherein the at least one hook portion comprises two hook portions.

8. The system of claim 1, wherein the tow rope attachment member extends away from the base as the tow rope attachment member extends away from the cylindrical tube.

9. The system of claim 1, wherein the inflatable towable vehicle further comprises at least one fabric cover layer, wherein the base is positioned between the at least one fabric cover layer and the bottom side of the inflatable towable vehicle.

10. The system of claim 9, wherein the at least one fabric cover layer comprises two nylon layers and a tarpaulin layer.

11. The system of claim 9, wherein the inflatable towable vehicle further comprises a reinforcement ring around a portion of the spinner apparatus that extends from the bottom side of the inflatable towable vehicle, wherein the at least one fabric cover layer is positioned between the reinforcement ring and the base.

12. The system of claim 11, wherein the inflatable towable vehicle further comprises a second reinforcement ring over outer circumferential edges of the at least one fabric cover layer, wherein the at least one fabric cover layer is positioned between the second reinforcement ring and the bottom side of the inflatable towable vehicle.

13. The system of claim 1, wherein the spinner apparatus is composed at least in part of at least one metal.

14. The system of claim 1, further comprising a tow rope connected to the tow rope attachment member.

15. The system of claim 14, further comprising a watercraft connected to the tow rope.

16. The system of claim 15, wherein the inflatable towable vehicle is configured to rotate more quickly as the watercraft turns than as the watercraft drives straight.

17. An inflatable towable vehicle, comprising:

a bottom side; and a spinner apparatus attached to the bottom side of the inflatable towable vehicle, at least a portion of the spinner apparatus configured to be submerged when the inflatable towable vehicle is towed in water, the spinner apparatus comprising:

a base configured to abut the bottom side of the inflatable towable vehicle when the spinner apparatus is attached to the bottom side of the inflatable towable vehicle;

a post extending from the base;

a cylindrical tube, wherein the post extends through the cylindrical tube, wherein the cylindrical tube is configured to rotate around the post; and a tow rope attachment member attached to and extending from the cylindrical tube, wherein the base comprises at least two strap rings, each of the at least two strap rings forming a strap hole, wherein the at least two strap rings comprises four strap rings equally radially spaced apart, wherein the inflatable towable vehicle is configured to rotate as the inflatable towable vehicle is towed.

18. A spinner apparatus, comprising:

a base configured to abut a bottom side of an inflatable towable vehicle when the spinner apparatus is attached to the bottom side of the inflatable towable vehicle;

a post extending from the base;

a cylindrical tube, wherein the post extends through the cylindrical tube, wherein the cylindrical tube is configured to rotate around the post; and a tow rope attachment member attached to and extending from the cylindrical tube, wherein the base comprises at least two strap rings, each of the at least two strap rings forming a strap hole, wherein the at least two strap rings comprises four strap rings equally radially spaced apart.

19. A system, comprising:

an inflatable towable vehicle, comprising:

a spinner apparatus attached to a bottom side of the inflatable towable vehicle, at least a portion of the spinner apparatus configured to be submerged when the inflatable towable vehicle is towed in water, the spinner apparatus comprising:

a base configured to abut the bottom side of the inflatable towable vehicle when the spinner apparatus is attached to the bottom side of the inflatable towable vehicle;

a post extending away from the base;

a cylindrical tube, wherein the post extends through the cylindrical tube, wherein the cylindrical tube is configured to rotate around the post; and a tow rope attachment member attached to and extending from the cylindrical tube, wherein the inflatable towable vehicle is configured to rotate as the inflatable towable vehicle is towed, wherein the inflatable towable vehicle further comprises at least one fabric cover layer, wherein the base is positioned between the at least one fabric cover layer and the bottom side of the inflatable towable vehicle, wherein the at least one fabric cover layer comprises two nylon layers and a tarpaulin layer.

20. A system, comprising:

an inflatable towable vehicle, comprising:

a spinner apparatus attached to a bottom side of the inflatable towable vehicle, at least a portion of the spinner apparatus configured to be submerged when the inflatable towable vehicle is towed in water, the spinner apparatus comprising:

a base configured to abut the bottom side of the inflatable towable vehicle when the spinner apparatus is attached to the bottom side of the inflatable towable vehicle;

a post extending away from the base;

a cylindrical tube, wherein the post extends through the cylindrical tube, wherein the cylindrical tube is configured to rotate around the post; and a tow rope attachment member attached to and extending from the cylindrical tube, wherein the inflatable towable vehicle is configured to rotate as the inflatable towable vehicle is towed, wherein the inflatable towable vehicle further comprises at least one fabric cover layer, wherein the base is positioned between the at least one fabric cover layer and the bottom side of the inflatable towable vehicle, wherein the inflatable towable vehicle further comprises a reinforcement ring around a portion of the spinner apparatus that extends from the bottom side of the inflatable towable vehicle, wherein the at least one fabric cover layer is positioned between the reinforcement ring and the base.

* * * * *